United States Patent [19]

Campbell et al.

[11] 4,003,319

[45] Jan. 18, 1977

[54] TUBULAR THROUGH SILL RAILWAY HOPPER CAR

[75] Inventors: George C. Campbell, Overland; James C. Hammonds; Dallas W. Rollins, both of St. Charles, all of Mo.

[73] Assignee: ACF Industries, Incorporated, New York, N.Y.

[22] Filed: May 27, 1975

[21] Appl. No.: 581,100

Related U.S. Application Data

[62] Division of Ser. No. 439,781, Feb. 5, 1974, Pat. No. 3,918,370.

[52] U.S. Cl. ..... 105/248; 105/360; 105/416; 105/418; 105/421

[51] Int. Cl.[2] ..... B61D 5/00; B61D 7/00; B61F 1/02; B61F 1/10

[58] Field of Search ..... 105/247, 248, 249, 250, 105/251, 252, 253, 358, 360, 368 B, 411, 413, 416, 417, 418, 421; 65/244

[56] References Cited

UNITED STATES PATENTS

| | | | |
|---|---|---|---|
| 663,030 | 12/1900 | King | 105/248 |
| 983,277 | 2/1911 | Harrigan | 105/248 |
| 1,630,001 | 5/1927 | Gardner | 105/411 X |
| 1,859,261 | 5/1932 | Mussey et al. | 105/249 |
| 1,943,294 | 1/1934 | Bender | 105/249 |
| 2,079,862 | 5/1937 | Kiesel, Jr. | 105/247 X |
| 2,084,161 | 6/1937 | Moss | 105/418 |
| 2,094,967 | 10/1937 | Schroeder | 105/248 X |
| 2,366,609 | 1/1945 | Gates | 65/244 |
| 2,366,709 | 1/1945 | Dean | 105/418 |
| 2,519,320 | 8/1950 | Meldrum | 105/416 |
| 3,040,679 | 6/1962 | Warntz | 105/416 X |
| 3,339,499 | 9/1967 | Charles et al. | 105/360 X |
| 3,490,387 | 1/1970 | Halcomb | 105/248 |
| 3,538,857 | 11/1970 | Mowatt-Larssen | 105/416 |
| 3,577,933 | 5/1971 | Ferris | 105/416 X |
| 3,921,537 | 11/1975 | Fleshman et al. | 105/248 |

*Primary Examiner*—Robert J. Spar
*Assistant Examiner*—Howard Beltran
*Attorney, Agent, or Firm*—Henry W. Cummings

[57] ABSTRACT

In accordance with the present invention a railway hopper car is provided having an enclosed quadrilateral tube as a through sill. The enclosed tube through sill has end portions which are welded to the car end sills at opposite ends of the car. The end sills are integrally attached to the side sills. The end sections also have attached thereto a center plate and a bolster cover plate. The bolster cover plate extends from the center sill to the side sill. At least one bolster web extends vertically from the bolster cover plate to the end sheet of the car. The hopper slope sheets are reinforced by means of generally triangular shaped members attached to the through sill and attached to the hopper slope sheets.

15 Claims, 23 Drawing Figures

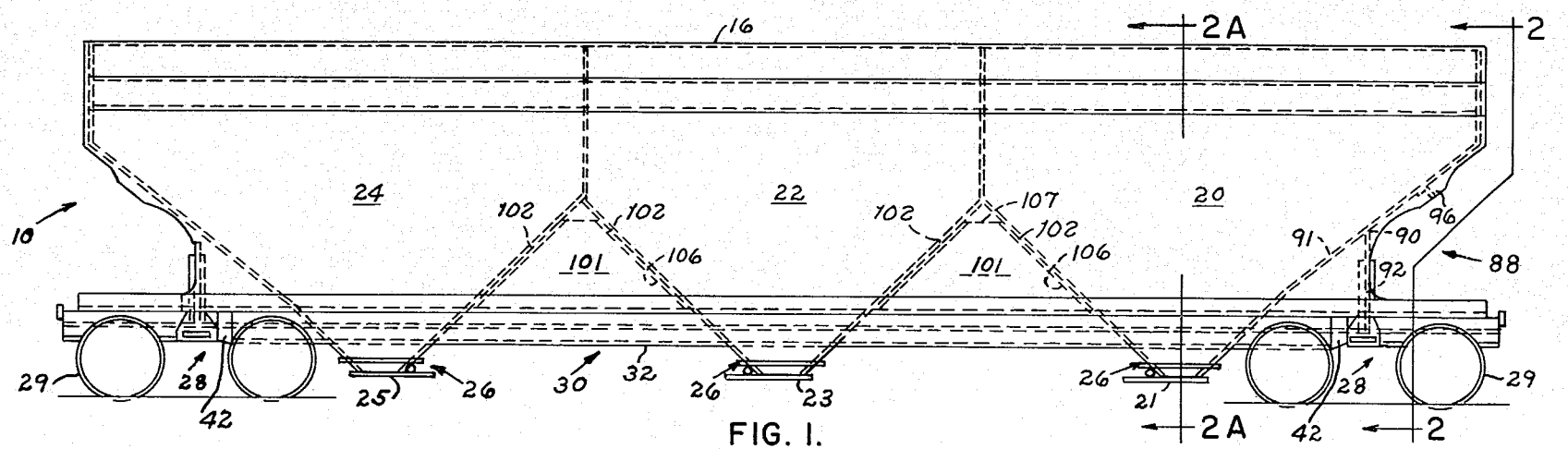
FIG. 1.
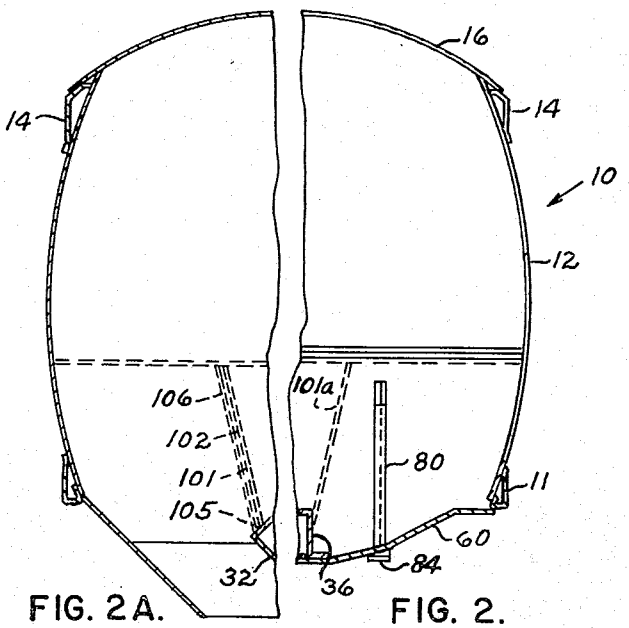
FIG. 2.
FIG. 2A.
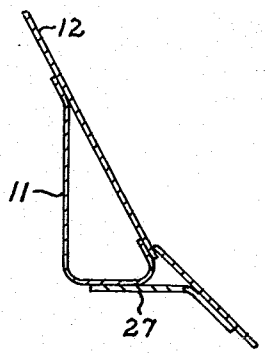
FIG. 2B.
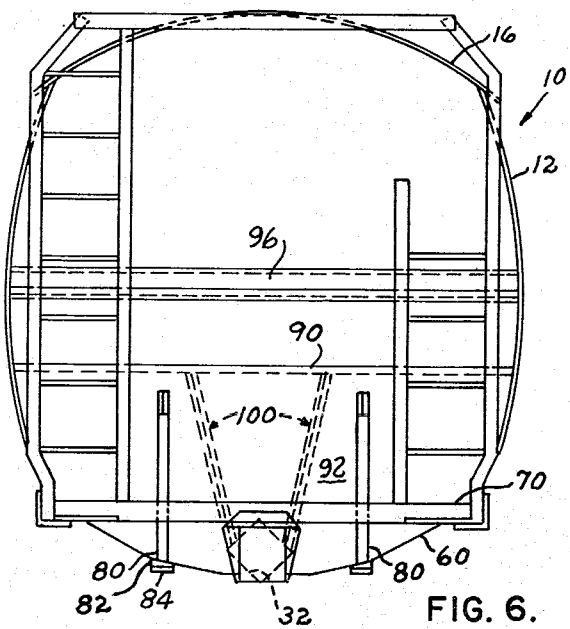
FIG. 6.

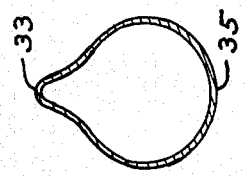
FIG. 13.
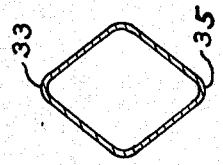
FIG. 12.
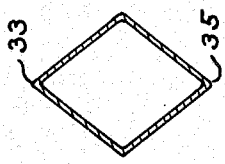
FIG. 11.
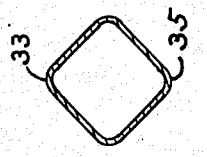
FIG. 10.
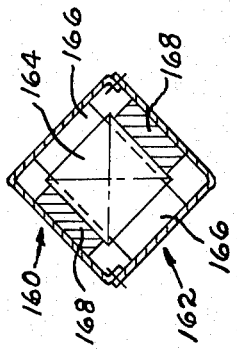
FIG. 19.
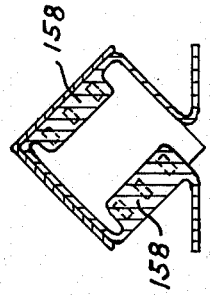
FIG. 18.
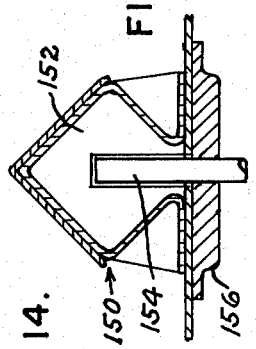
FIG. 17.
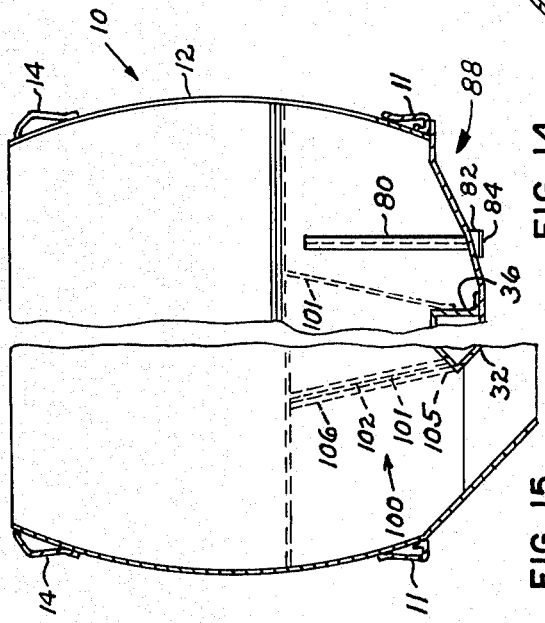
FIG. 14.
FIG. 15.
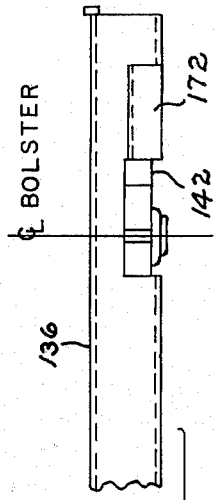
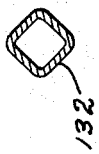
FIG. 16a.
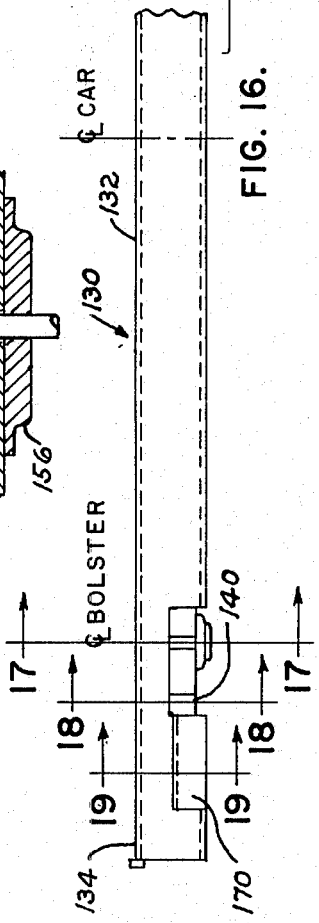
FIG. 16.

TUBULAR THROUGH SILL RAILWAY HOPPER CAR

This application is a division of our copending application Ser. No. 439,781, filed Feb. 5, 1974 now U.S. Pat. No. 3,918,370, issued Nov. 11, 1975.

BACKGROUND OF THE INVENTION

U.S. Pat. Nos. 3,339,499 and 3,490,387 illustrate hopper car constructions having stub sills and wherein the longitudinal loads are transmitted to the stub sill, to a shear plate, then outwardly to the side sills, and from the side sills into the car body. In accordance with the construction of these patents vertical turning moments are taken out by diagonal stiffeners at opposite ends of the car. The shear plate, side sills and the diagonal stiffeners add significantly to the weight of the car.

There is an AAR requirement that a 100 ton railway hopper car not exceed 263,000 pounds loaded. Most railroads and shippers are anxious to have a car in which they can load 100 tons of lading and at the same time not be concerned about the weight of specialty items, such as multi-wear wheels, center fillers and trucks (particularly side frames and truck bolsters) which they may wish to order with the car.

The weight of the hopper car according to the above mentioned patents for high capacity design may vary by as much as 1000 pounds or more but usually turns out to be between 63,000 and 64,000 pounds.

It therefore would be desirable to reduce the weight of the car to 60,000 lbs. and even lower, so that the user may load a 100 ton load and at the same time order the specialty items of the car which he wishes, regardless of their weight.

In application Ser. No. 439,782, filed Feb. 5, 1974, now U.S. Pat. No. 3,921,537 filed on even date herewith, a railway hopper car is disclosed in which the weight of the car is reduced through the use of a through center sill. The shear plate and diagonal stiffeners described in the aforementioned '499 and '387 patents may be eliminated. Also by the use of this through sill construction, it is possible to reduce the thickness of the side sheets and the side sill, and thus further reduce weight. In accordance with this construction it is possible to reduce the nominal weight of the car to below 60,000 pounds without controlling the weight of specialty items in the car.

Conventional through sill construction usually includes a hat shaped cross section and the use of hoods in the hoppers over the through sill to allow the lading to pass around the through sill and not be impeded thereby. This usually means that the hat-section flanges must be cut off from the through sill in the hopper area and reinforcements welded within the through sill in the hopper area. These operations require considerable man hours and are therefore expensive.

A bottom and top cover plate are generally required for the through sill at the end of the car. These plates require man hours to fabricate and weld in place.

Moreover, the bottom and top cover plates, and hoods are all weight members and it is desired to reduce as much as possible the weight of the car consistent with sound structural design.

In U.S. Pat. Nos. 1,943,294; 2,084,161; 2,519,320 and 3,040,679 it has been proposed to use a tubular center sill of circular cross section. However, the upper surface of a circular cross section has been found to be a place where some lading hangs up during unloading, and thus making a contamination problem.

U.S. Pat. Nos. 1,859,261 and 2,366,709 disclose non-circular tubes having at least five sides, making fabrication of such multi-sided tubes difficult and expensive. Furthermore, the latter with its flat lower surface results in inefficient use of space in the hoppers because a void is created during loading under this flat surface.

SUMMARY OF THE INVENTION

In accordance with the present invention a railway hopper car is provided having an enclosed quadrilateral tube as a through sill. The enclosed tube through sill has end portions which are welded to the car end sills at opposite ends of the car. The end sills are integrally attached to the side sills. The end sections also have attached thereto a center plate and a bolster cover plate. The bolster cover plate extends from the center sill to the side sill. At least one bolster web extends vertically from the bolster cover plate to the end sheet of the car. The hopper slope sheets are reinforced by means of generally triangular shaped members attached to the through sill and attached to the hopper slope sheets. Squeeze loads are taken substantially entirely by the through sill. Impact loads are taken by the through sill and are distributed at least in part to the remainer of the car by said triangular members.

THE DRAWINGS

FIG. 1 is a side elevational view of the hopper car according to the present invention;

FIG. 2 is a partial sectional view along the lines 2—2 in FIG. 1;

FIG. 2A is a partial sectional view along the lines 2A—2A in FIG. 1;

FIG. 2B is a detail view of the side sill-hopper outlet connection;

FIG. 6 is an end view of the hopper car according to the present invention;

FIG. 10 is a sectional view of a rounded square cross section center sill according to the present invention;

FIG. 11 is a sectional view of a diamond cross section center sill according to the present invention;

FIG. 12 is a sectional view of a rounded diamond cross section center sill according to the present invention;

FIG. 13 is a sectional view of a "tear drop" shaped cross section center sill according to the present invention;

FIGS. 14 and 15 are views similar to FIGS. 2 and 2A illustrating the present invention as applied to an open top hopper car;

FIG. 16 is a view of a single enclosed tube center sill according to the present invention;

FIG. 16a is a cross-sectional view of the single enclosed tube center sill;

FIG. 17 is a view along the lines 17—17 in FIG. 16;

FIG. 18 is a view along the lines 18—18 in FIG. 16; and

FIG. 19 is a view along the lines 19—19 in FIG. 16.

DESCRIPTION OF PREFERRED EMBODIMENTS

Figure 3:
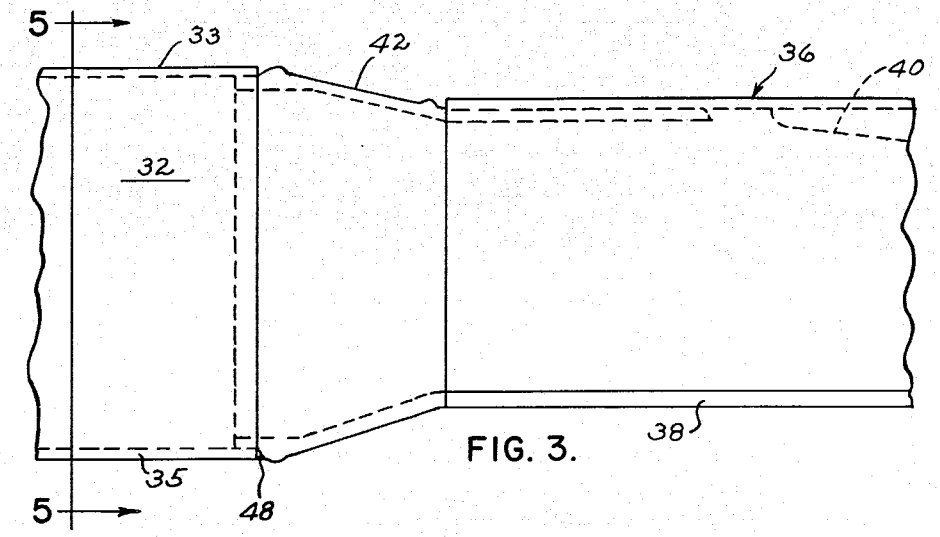
FIG. 3 is a side elevational view of the end portion of the center sill of the present invention.

In accordance with the present invention a railway hopper car is indicated in the drawings generally at 10. The car comprises side sills 11 extending longitudinally along opposite sides of the car having sides 12 welded thereto, preferably curved as shown. The sides 12 in turn are welded to top chords 14. A curved roof portion 16 joins the top chords 14 in the embodiment shown in FIGS. 2 and 2A.

The car is provided with a plurality of hoppers 20, 22 and 24. Of course, more or less hoppers could be provided, if desired. The hopper is provided with appropriate outlets 26 of known construction. The lower hopper portions 21, 23 and 25 of the hoppers are welded to side sills 11. If desired, reinforcing plates 27 may be used for this connection, for example, having an angle shape as shown in FIG. 2B. Conventional trucks 28 having wheels 29 support the car at opposite ends thereof.

Figure 5:
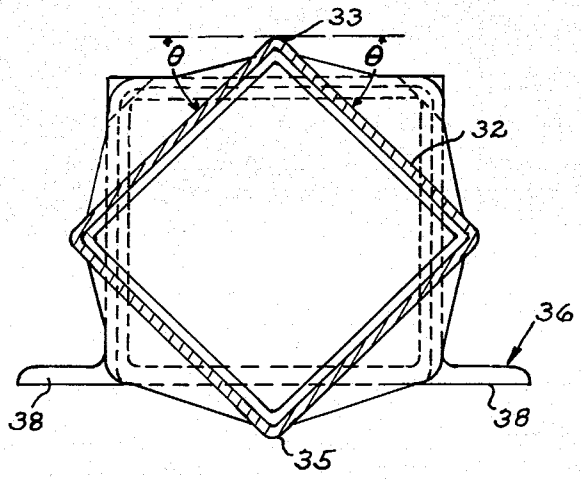
FIG. 5 is a sectional view view of the center sill along the lines 5—5 in FIG. 4.
Figure 9:
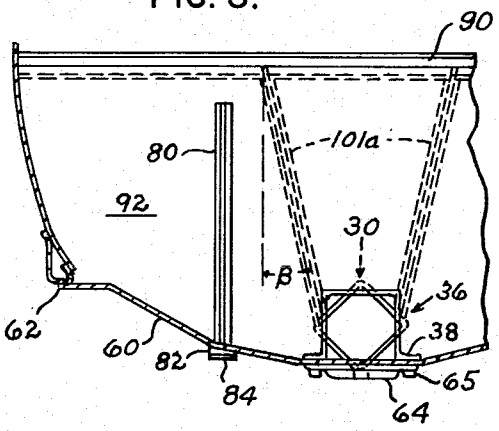
FIG. 9 is a view along the lines 9—9 in FIG. 8.

A tubular center sill indicated generally at 30 extends between the ends of the car and passes through the hoppers 20, 22 and 24. Center sill 30 is in the form of a closed tube 32, having an upper apex 33 inserted into the car so as to make an angle $\theta$ of about 30° to about 60° with respect to the horizontal (FIG. 5). The tube should be easy to fabricate. Furthermore, the lower surface of the tube should not result in a large void area during loading as would, for example, a flat lower surface. Thus, cross-sectional shapes which satisfy these requirements are quadrilateral and derivatives of circular which provide an upper apex, particularly the tear drop shape shown in FIG. 14. The preferred quadrilateral shape is a parallelogram. Most preferably the parallelograms are square (FIG. 9), diamond shaped (FIG. 12), rounded square (FIG. 10), or rounded diamond (FIG. 13).

The tube thus comprises an upper apex 33 extending into the hopper which acts to shed lading and allow it to move smoothly and easily around the center sill during loading and unloading. Space in the hopper is saved which previously would be lost due to the hood. The enclosed tube also comprises a lower apex 35 which tends to avoid a void space which a flat section below the upper apex would tend to cause. While the tear drop shape has a lower apex as shown in FIG. 13, the parallelogram shapes are more effective in this regard than is the tear drop. Thus space loss is minimized due to the through sill design.

Figure 4:
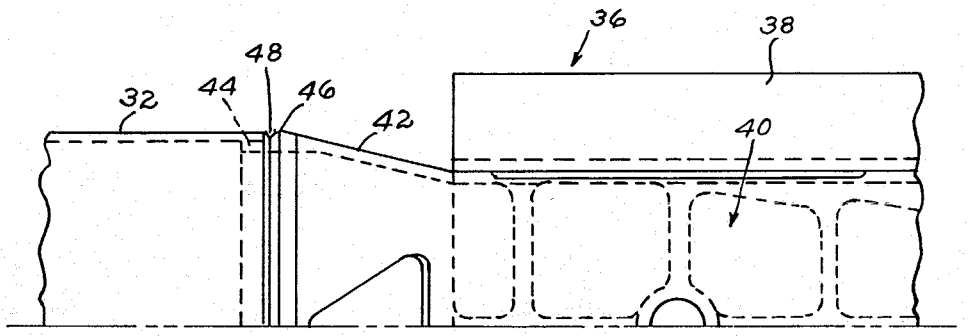
FIG. 4 is a bottom view of the end portion of the center sill of the present invention.

At the ends of the car a conventional hat section type center sill 36 may be utilized having the usual horizontally extending flanges 38 (FIGS. 3 and 4). Mounted within the center sill 36 is a conventional center filler and draft gear housing indicated in the drawings at 40. The center filler is of conventional construction and may be either fabricated or cast. However, inboard of the center filler 40 there preferably is provided a transition section 42. Section 42 may, for example, be cast integral with the member 40 or may be welded thereon. Enclosed tube 32 preferably is dimensioned so as to fit over the inboard end portion 44 of transition section 42. Preferably transition section 42 is provided with a collar 46 to facilitate joining of transition section 42 and tube 32. The tube 32 is then welded to transition section 42 as indicated at 48.

Figure 5A:
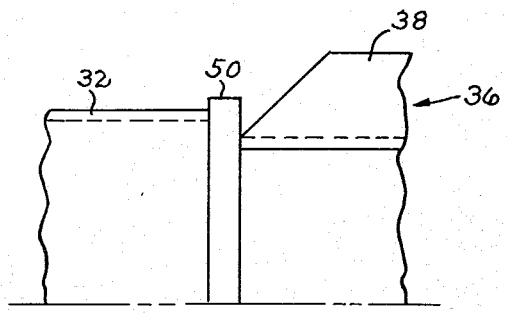
FIG. 5A is a detailed view similar to FIG. 4 of an alternative center sill transition section according to the present invention.
Figure 7:
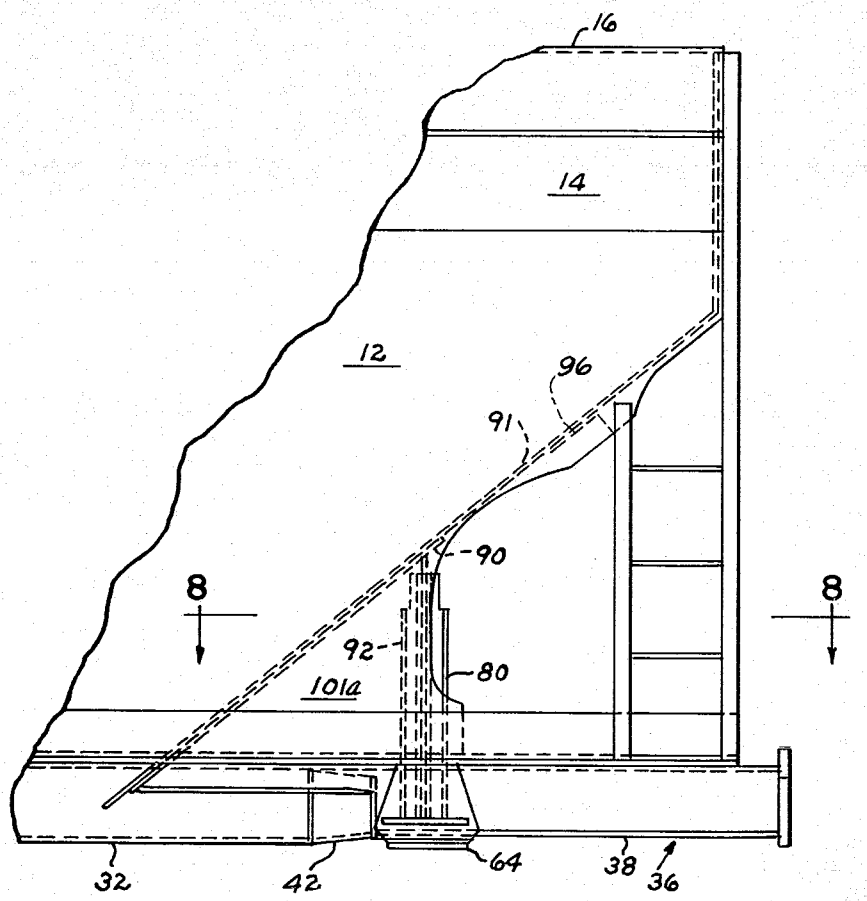
FIG. 7 is a side elevational view of the end portion of the hopper car according to the present invention.

An alternative transition arrangement is shown in FIG. 5A. Enclosed tube 32 and end section 36 are each welded to a plate 50. Thus, in the embodiment shown in FIG. 5A, plate 50 becomes the equivalent of transition member 42 in the embodiment shown in FIGS. 3–5. End center sill 36 may have the flanges 38 removed prior to welding to plate 50, in which case plate 50 may be of thinner gage material.

Another alternative is that the entire center sill 130 including a center portion 132 and end portions 134 and 136 comprise a single enclosed tube as shown in FIGS. 16–19. The bottom portions 140 and 142 of the tube may be cut out at the end portions to install the draft gear coupling equipment and center filler. Then an assembly 150, for example, a casting, may be inserted into the cutout portions, including a center filler 152, center plate 156, and a center pin 154. The assembly may also include rear draft gear lugs 158.

A second assembly indicated at 160 is also inserted which may comprise resilient draft gear 164, stopping blocks 166 and coupler yokes 168. Then a draft gear carrier 162, comprising foreshortened bottom portions 170 and 172 are fastened or welded in place to cutout portions 140 and 142. Thus, in this embodiment, there would be no identifiable transition section.

Figure 8:
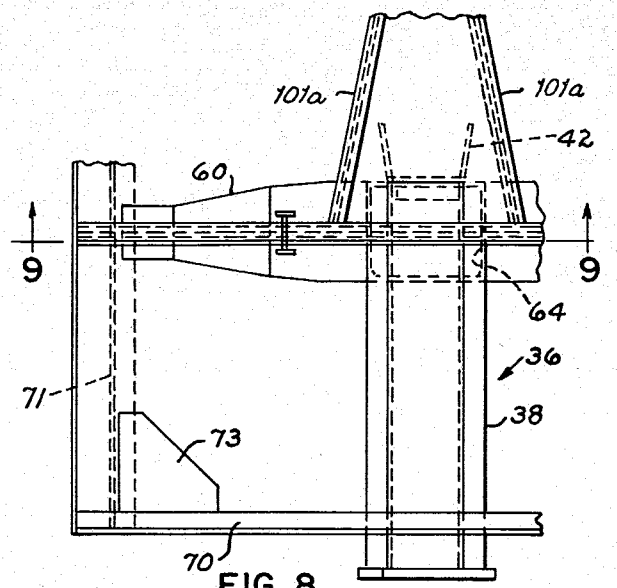
FIG. 8 is a view along the lines 8—8 in FIG. 7.

In the end portion of the car a lower bolster cover plate 60 (FIGS. 8 and 9) is welded to the end center sill section 36. Plate 60 extends over to and is welded to side sills 11 as indicated at 62. Also welded to the center sill 32 is an end sill 70. The end sill is welded to the extensions 71 of the side sill 11 and end sill gussets 73 may be provided therebetween. Gussets 73 reinforce the end sill so the latter can withstand impacts such as occur, for example, with coupler by-passing and collisions with forklift trucks and other vehicles.

A center plate 64 is preferably affixed to flanges 38 and plate 60 with appropriate fasteners, for example, by means of rivets 65. Side bearings 84 are integrally affixed, preferably by welding to bottom cover plate 60. If desired, shims 82 may also be provided between the cover plate and side bearings 84.

Car end reinforcement is indicated generally at 88. A bolster top cover plate 90 extends across the end slope sheet 91 and is welded thereto. A vertically extending bolster web 92 is welded to lower bolster cover plate 60 and to bolster top cover plate 90 and/or end slope sheets 91. Side bearing supports 80 are welded to vertical web 92 and to lower bolster cover plate 60 above side bearings 84.

Slope sheet reinforcement means indicated generally at 100 is provided between the slope sheets of the car and center sill 32. Preferably this slope sheet reinforcement means includes triangular members 101 having sides 102 extending along the slope sheets and base portions 104 which are welded to the sill 32 as shown at 105 (FIG. 2A). As shown in FIGS. 2, 2A, and 6, triangles 101 are inclined with respect to the vertical to form an angle $\beta$ (FIG. 9) from 2° to 30°, preferably 5° to 15°. Preferably plates 106 are welded to the slope sheets and triangular legs 102 welded to plates 106 to provide more effective slope sheet reinforcement. If desired, triangles 101 may be cut off as indicated at 107 (FIG. 1) near the jointure of legs 102 to facilitate welding the triangles in place to the hopper slope sheets and/or plates 106.

End slope sheet reinforcement may be provided by triangular plates 101*a* engaging the center sill 32, slope sheet 91 and vertical web 92. Also a plate or beam, for example, an angle 96 may be provided extending transversely across the end slope sheets.

In accordance with this arrangement a large portion, at least above about 60% and preferably more than about 70% of the squeeze load is carried by the through center sill. Impact loads are received by the center sill and are distributed to the car body through reinforcing means 100.

The side sill is principally utilized as a bottom chord for the side sheets. The side sheets and top chords support the car vertically along the length of the car, with this vertical load being transmitted from the sides to the truck through the vertical bolster web 92 and bolster cover plate 60.

The enclosed tube center sill of the present invention may also be used in an open top hopper as shown in FIGS. 14 and 15. Reinforcing means 100, preferably triangular shaped members 101 are provided between the hoppers. The car end reinforcing means 88 is preferably provided as described above in connection with the covered hopper car.

It will be apparent that the enclosed tube type center sill avoids the need for removing the flanges from the usual hat section used for a through sill. Furthermore, it avoids providing reinforcement in the inside of the hat section. The upper apex greatly reduces or avoids lading entrapment and the curved lower surface reduces the void space below the center sill formed during loading.

Furthermore, if it is desired to reduce weight, a single bolster cover plate may be used rather than two which were normally utilized in previous constructions. The inclined triangles provide low weight slope sheet support. It is thus apparent that the constructions of the present invention result in lower man hours of fabrication time and thus less cost and may be used to obtain less car weight.

What is claimed is:

1. A railway hopper car comprising:

spaced apart sides on opposite sides of said car joining longitudinally extending side sills and top chords; at least one transverse bulkhead joining said sides to define a plurality of hoppers in said car; said hoppers having converging slope sheets extending transversely of the car; the hoppers at opposite ends of the car having end slope sheets; a through sill extending throughout the length of said car; said through sill comprising in cross section an enclosed tube of quadrilateral cross section including an apex extending upwardly into the hoppers to shed the lading; said through sill comprising at opposite end portions thereof end sections each having an end sill welded thereto; each of said end sections having affixed thereto a center plate and a bolster cover plate; said bolster cover plate extending transversely from said end section to each of said side sills and welded thereto; a vertical bolster web joining respectively each of said end sections to one of said end slope sheets; and hopper slope sheet reinforcing structure including generally triangular shaped members attached to said through sill, and attached and supporting said slope sheets.

2. A railway hopper car according to claim 1 wherein said quadrilateral cross section is square.

3. A railway hopper car according to claim 1 wherein said quadrilateral cross section is diamond.

4. A railway hopper car according to claim 2 wherein said square cross section has rounded corners.

5. A railway hopper car according to claim 3 wherein said diamond cross section has rounded corners.

6. A railway hopper car according to claim 1 wherein said triangles are inclined with respect to the vertical.

7. A covered hopper railway car comprising:

spaced apart sides on opposite sides of said car joining longitudinally extending side sills and top chords; a roof joining said top chords; at least one transverse bulkhead joining said sides to define a plurality of hoppers in said car; said hoppers having converging slope sheets extending transversely of the car; the hoppers at opposite ends of the car having end slope sheets; a through sill extending throughout the length of said car; said through sill comprising in cross section an enclosed tube of quadrilateral cross section including an apex extending upwardly into the hoppers to shed the lading; said through sill comprising at opposite end portions thereof end sections each having an end sill welded thereto; each of said end sections having affixed thereto a center plate and a bolster cover plate; said bolster cover plate extending transversely from said end section to each of said side sills and welded thereto; a vertical bolster web joining respectively each said end sections to one of said end slope sheets; and hopper slope sheet reinforcing structure including generally triangular shaped members attached to said through sill, and attached to and supporting said slope sheets.

8. A railway hopper car according to claim 7 wherein said quadrilateral cross section is square.

9. A railway hopper car according to claim 7 wherein said quadrilateral cross section is diamond.

10. A railway hopper car according to claim 7 wherein said triangles are inclined with respect to the vertical.

11. An open top railway hopper car comprising:

spaced apart sides on opposite sides of said car joining longitudinally extending side sills and top chords; at least one transverse bulkhead joining said sides to define a plurality of hoppers in said car; said hoppers having converging slope sheets extending transversely of the car, the hoppers at opposite ends of the car having end slope sheets; a through sill extending throughout the length of said car; said through sill comprising in cross section an enclosed tube of quadrilateral cross section including an apex extending upwardly into the hoppers to shed the lading; said through sill comprising at opposite end portions thereof end sections each having an end sill welded thereto; each of said end sections having affixed thereto a center plate and a bolster cover plate; said bolster cover plate extending transversely from said end sections to each of said side sills and welded thereto; a vertical bolster web joining respectively each said end section to one of said end slope sheets; and hopper slope sheet reinforcing structure including generally triangular shaped members attached to said through sill, and attached to and supporting said slope sheets.

12. An open top railway hopper car according to claim 11 wherein said quadrilateral cross section is square.

13. An open top railway hopper car according to claim 11 wherein said quadrilateral cross section is diamond.

14. An open top railway hopper car according to claim 11 wherein said triangles are inclined with respect to the vertical.

15. An open top hopper car comprising:

spaced apart sides on opposite sides of said car joining longitudinally extending side sills and top chords; a through sill extending between hoppers in said car throughout the length thereof; said through sill within said hoppers comprising in cross section an enclosed tube having a parallelogram cross section extending upwardly into the hopper making an acute angle with the horizontal; said through sill comprising at the end portions thereof end sections; said end sections each having an end sill welded thereto, said end sills integrally affixed to said side sills; said end sections also having affixed thereto a center plate and a bolster cover plate, said bolster cover plate extending from the center sill to each of said side sills and welded thereto; car end reinforcing structure extending vertically from said bolster cover plate to said end slope sheet; and hopper slope sheet reinforcing structure attached to the hopper slope sheets and to said through sill comprising generally triangular shaped members whereby squeeze loads are substantially entirely taken by said through sill and impact loads are taken substantially entirely by said through sill and are distributed to the rest of the car at least in part by said triangular members.

* * * * *